US005699577A

United States Patent [19]

Rankin

[11] Patent Number: 5,699,577

[45] Date of Patent: Dec. 23, 1997

[54] MAGNETIC CLEANING PIG

[75] Inventor: William Jack Rankin, Sapulpa, Okla.

[73] Assignee: TDW Delaware, Inc., Wilmington, Del.

[21] Appl. No.: 773,696

[22] Filed: Dec. 27, 1996

[51] Int. Cl.[6] ..... B08B 9/04

[52] U.S. Cl. ..... 15/104.061

[58] Field of Search ..... 15/104.061; 209/215

[56] References Cited

U.S. PATENT DOCUMENTS

| | | | |
|---|---|---|---|
| 3,292,197 | 12/1966 | Stephens | 15/104.06 |
| 3,460,028 | 8/1969 | Beaver et al. | 324/37 |
| 3,546,642 | 12/1970 | Frederick et al. | 335/305 |
| 3,600,736 | 8/1971 | Smith et al. | 15/104.061 |
| 3,673,629 | 7/1972 | Casey et al. | 15/104.061 |
| 4,057,081 | 11/1977 | Jones | 138/97 |
| 4,113,611 | 9/1978 | Gohm | 209/215 |
| 4,345,350 | 8/1982 | Burd | 15/104.061 |
| 4,524,526 | 6/1985 | Levine | 33/312 |
| 4,717,875 | 1/1988 | Lara | 324/220 |
| 4,767,603 | 8/1988 | Byrd et al. | 15/104.061 X |
| 4,945,306 | 7/1990 | Lowther | 324/220 |
| 5,035,021 | 7/1991 | Le Devehat | 15/104.061 |
| 5,461,746 | 10/1995 | Banik et al. | 15/104.061 |

FOREIGN PATENT DOCUMENTS

| | | | |
|---|---|---|---|
| 31 22 643 | 1/1983 | Germany . | |
| 1417943 | 8/1988 | Sweden . | |
| 956074 | 9/1982 | U.S.S.R. | 15/104.061 |

*Primary Examiner*—Mark Spisich
*Attorney, Agent, or Firm*—Head, Johnson & Kachigian

[57] ABSTRACT

A cleaning device for passing through a pipeline for removal of ferro-magnetic debris includes an elongated body having at least two spaced apart elastomeric cups that fit within a pipeline to be cleaned, the cups supporting the body so that its elongational axis is substantially co-axial with the pipeline cylindrical wall. A carrier is supported by the body and has a peripheral surface spaced adjacent to the pipeline internal wall. At least one permanent magnet is supported by the carrier peripheral surface and adjacent to the pipeline internal wall. A structure is provided to maintain the magnet oriented in the direction of, or parallel to, and adjacent the pipeline internal wall bottom portion so that the magnet attracts and retains ferro-magnetic debris. In one embodiment the carrier is free to rotate about the elongated body so that if the cleaning device rotates as it moves through a pipeline the magnet or magnets carried thereby are always positioned adjacent the pipeline bottom interior surface. In another embodiment, the carrier is fixed to the cleaning device body. A weight is attached to the body to prevent the cleaning device from rotating and to thereby maintain the peripheral surface of the carrier having the magnet therein adjacent the pipeline interior bottom.

23 Claims, 3 Drawing Sheets

MAGNETIC CLEANING PIG

BACKGROUND OF THE INVENTION

1. Field of the Invention

The present invention relates to an improved magnetic cleaning pig. The term "pig" is used in the industry to identify a physical device that moves through a pipeline by the force of fluid flow.

2. Prior Art

For background information relating to magnetic cleaning pigs reference may be had to U.S. Pat. No. 5,461,746 issued Oct. 31, 1995, entitled "Magnetic Cleaning Pig". Further background information can be obtained from the following previously issued patents:

| PATENT NO. | INVENTOR | TITLE |
|---|---|---|
| U.S. 3292197 | Stephens | Pipe Line Scraper With Magnetic Pickup Means |
| U.S. 3460028 | Beaver et al | Pipeline Inspection Apparatus With Means For Correlating The Recorded Defect Signals With The Angular Position Within The Pipeline At Which They Were Generated |
| U.S. 3546642 | Frederick et al | Pigging Device |
| U.S. 3673629 | Casey et al | Magnetic Pipeline Pigs |
| U.S. 4057081 | Jones | Pipeline Pigs |
| U.S. 4113611 | Gohm | Magnetic Pipe Cleaner |
| U.S. 4345350 | Burd | Pipeline Cleaning Equipment |
| U.S. 4524526 | Levine | Apparatus And Method For Inertial Measurement of Pipeline Deflection |
| U.S. 4717875 | Lara | Method and System For Determining Curvature In Fluid Transmission Pipelines |
| U.S. 4945306 | Lowther | Coil and Hall Device Circuit For Sensing Magnetic Fields |
| DE 31 22 643 A1 | Redar | Anordnung zur Markierung und Ortung von Molchen in Rohrleitungssysteemen, Insbesondere Pipelines |
| SU 1417-943-A | Moscow Steel Alloys Inst. | Pipeline Inner Surface Cleaning Unit |

SUMMARY OF THE INVENTION

This invention is a cleaning device for passing through a pipeline (pipeline pig or cleaning pig) for removal of ferro-magnetic debris. Such ferro-magnetic debris can include portions of welding rods that are inadvertently left in a pipeline as the pipeline is constructed; wire bristles which can break off of cleaning pigs that are passed through the pipeline to clean the interior walls thereof; cutting chips introduced during construction of the pipeline; rust and so forth.

The cleaning pig includes an elongated body of cross-sectional dimension less than that of the cylindrical internal wall of the pipeline. Such elongated body may preferably be formed of a tubular member that has a diameter substantially less than the internal diameter of the pipeline in which the device is used. At least two supports are secured to the body. The typical support common on many types of pipeline pigs, is in the form of an elastomeric cup that has a circumferential peripheral surfaces that closely engage the interior circumferential wall of the pipeline. Such cups are commonly employed in pigs since they provide means to move the pig through the pipeline by the force of fluid flow, either liquid or gas, passing through the pipeline. In some instances, supports are provided by a circumferential array of wire brushes, or wheeled assemblies may be used to support or at least partially support a pipeline pig. Any structure that will support a pipeline pig so as to support the elongated body at least substantially concentrically within the pipeline will suffice in the construction of the cleaning pig of this invention.

A carrier is supported to the body and has a peripheral surface that is at least substantially concentric to and spaced adjacent the pipeline internal wall. A preferred carrier is in the form of a segment having a segmented circumferential peripheral surface that is in close proximity to the pipeline interior wall.

At least one permanent magnet is retained by the carrier adjacent to the circular peripheral surface so that the magnet is positioned adjacent to the interior circumferential surface of the bottom portion of a pipeline.

The cleaning device is arranged such that the circular peripheral surface of the carrier is always positioned adjacent to the internal bottom surface of the pipeline. By "internal bottom surface" is meant the gravitationally downward bottom portion of the pipeline, that is, the internal portion of the pipeline to which solid elements having a specific gravity greater than the fluid passing through the pipeline settle.

At least one permanent magnet is retained by the carrier adjacent to the circular peripheral surface and supported adjacent to the pipeline interior bottom surface.

The cleaning device is constructed and arranged so that the carrier circular peripheral surface remains, at all times, adjacent the pipeline interior bottom surface. This is accomplished by two embodiments illustrated herein as examples of the means to orientationally maintain the carrier circular peripheral surface adjacent the pipeline interior bottom surface. The first embodiment provides at least one circular guide secured to and surrounding the body. A ring is rotatably received about the body and rotatably retained by the circular guide. The carrier is attached to the ring. The ring responds rotationally to gravitational pull on the carrier so that even though the cleaning pig should rotate about its longitudinal axis as it moves through a pipeline, the carrier circumferential circular portion having a magnet therein remains disposed adjacent the interior bottom surface of the pipeline.

In another embodiment the carrier is at least substantially affixed to the body. A weight is secured to the body or to the supports so that the cleaning device is prevented from rotating as it passes through a pipeline. By orienting the carrier circumferential circular portion to be adjacent the pipeline interior bottom surface and by preventing the cleaning device from rotating as it moves through the pipeline, the magnet or magnets retained by the carrier will remain always positioned adjacent to the pipeline interior bottom surface.

The carrier may be in the form of a segment having an inner end supported to the ring or to the cleaning pig body, the segment having one or more magnets in the end thereof that is adjacent to the pipeline interior surface. In another embodiment the carrier is made up of a plurality of individual relatively narrow segments each having an inner end supported to the body or to a ring that rotates with respect to the body and each having an outer end having an opening therethrough. A permanent magnet is positioned within the opening. To retain a magnet in its opening, pole pieces are secured to the opposed surfaces of the segment and held in place by bolts. The pole pieces are preferably formed of para-magnetic material that functions to augment the magnetic field created by each magnet.

A better understanding of the invention will be obtained from the following description and drawings, taken in conjunction with the attached claims.

BRIEF DESCRIPTION OF THE DRAWINGS

FIG. 1 shows one embodiment providing rings that rotate in circumferential raceways in circular guides, the circular guides being secured to and around the body. The rings support carriers that retain magnets therein and provide a system whereby the magnets always are in close proximity to the pipeline interior bottom surface.

DETAILED DESCRIPTION OF THE PREFERRED EMBODIMENTS

Figure 1:
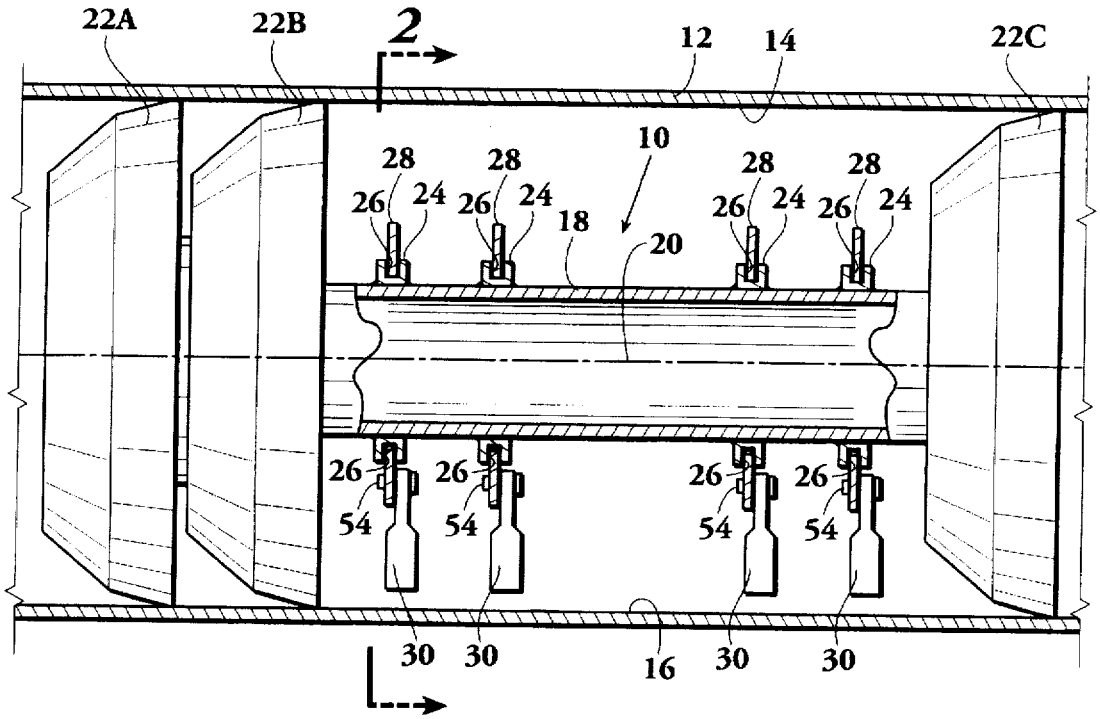
FIG. 1 is an elevational view of a portion of a pipeline shown in cross-section and showing a cleaning device of this invention positioned within the pipeline, the cleaning device having a body that is shown partially in cross-section.
Figure 2:
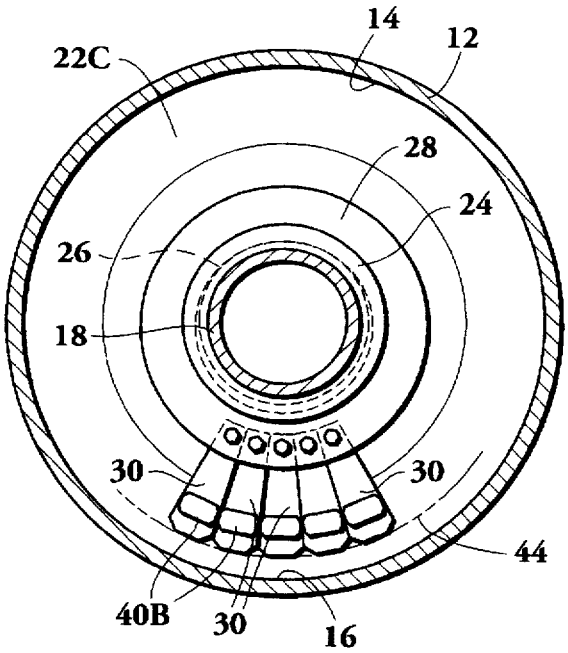
FIG. 2 is an elevational cross-sectional view taken along the line 2—2 of FIG. 1 showing the body in cross-section and showing the relationship of a guide, a ring and a carrier segment secured to the ring.

Referring to the drawings and first to FIGS. 1 and 2, a first preferred embodiment of the invention is illustrated. A cleaning device, commonly referred to in the industry as a cleaning pig, is indicated generally by the numeral 10, the cleaning pig being shown within the interior of a pipeline 12. Pipeline 12 has a cylindrical internal wall 14 having a gravitationally downward bottom portion 16. One of the functions of cleaning pig 10 is to gather and remove from the interior of the pipeline, ferro-magnetic debris, such debris being typically welding rods, wire bristles, cutting chips, rust, and so forth. Since ferro-magnetic materials are always heavier than the specific gravity of liquids and gases flowing through pipeline 12, such material inevitably settles to the gravitationally downward bottom portion 16.

Cleaning pig 10 includes an elongated body 18 which is typically tubular but the body may be of other configurations as long as the external dimensions taken in a cross-sections perpendicular to the body longitudinal axis 20 are less than the dimension of the pipeline internal wall 14.

The body 18 must be supported generally concentrically within pipe 12. For this reason, at least two supports, spaced apart from each other are affixed to the elongated body. Thus the body longitudinal axis 20 is substantially co-axial with the axis of the pipeline cylindrical internal wall 14. Whereas body 18 may be supported such as by slides, rollers, discs or so forth, a preferred and commonly employed means of supporting the body of a pipeline pig is by means of elastomeric cups. In FIG. 1, three such elastomeric cups are illustrated by the numeral 22A, 22B and 22C. The elastomeric cups 22A–22C, which are commonly made of polyurethane, provide the dual function of supporting body 18 and for providing propulsion through pipeline 12. That is, the flow of fluids, either liquids or gases through the pipeline impinge upon cups 22A through 22C to move the pipeline pig, the velocity of the pig being generally determined by the velocity of the fluid flow.

In the illustrated arrangement of FIG. 1, two cups 22A and 22B are placed at the forward end of body 18 and a single cup 22C at the rearward end to illustrate a typical pipeline pig. Only one cup 22A would be required at the forward end to support body 18 centrally within the pipeline, however the use of two cups is a common expedient since they provide pulling force to pull the pig through the pipeline. It has been learned that a pipeline pig functions better if the force moving it is a pulling force rather than a pushing force; thus two cups are typically employed at the front end of body 18 compared to a single cup at the rearward end.

While not shown, the pipeline pig 10 could include other features, such as brushes for scraping the interior of the pipeline to loosen rust and other encrustations. Further, the pipeline pig that employs this invention may incorporate instrumentation or may function as a "batching" pig, that is, a pig that functions to separate one type of fluid from another type of fluid flowing sequentially through the pipeline.

Affixed to the exterior surface of body 18 is at least one circular guide 24. In the illustrated arrangement four such circular guides 24 are shown. The circular guides are spaced apart from each other along the length of body 18. Each of the circular guides has a circumferential raceway 26 therein which is in the form of a circumferential groove or recess in the exterior surface of each circular guide.

Received within the recesses 26 in each of the circular guides is a ring 28. The rings are freely rotatable upon the guides within the raceways.

Secured to each of the rings is a plurality of segmented members indicated generally by the numeral 30.

Figure 7:
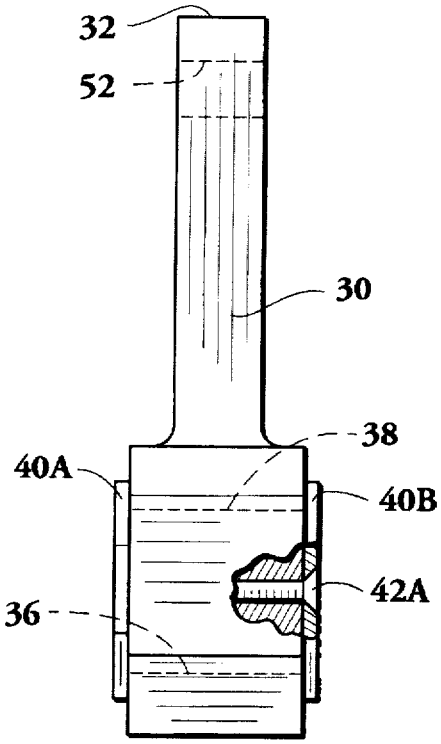
FIG. 7 is an elevational view, shown partially in cross-section, of the carrier segment shown in FIG. 6.
Figure 6:
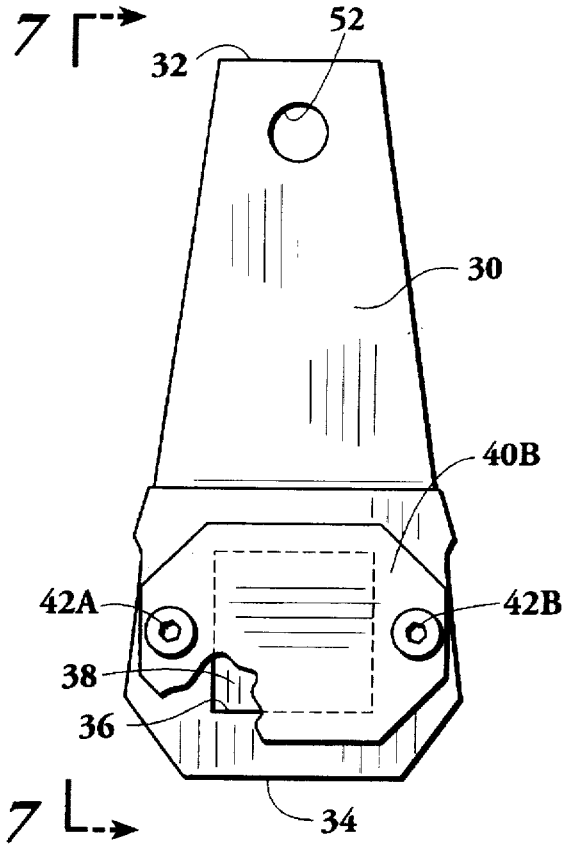
FIG. 6 is an enlarged elevational side view of one embodiment of a carrier in a form of a segment. This embodiment is preferably made of polyurethane or other elastomeric material that will flex to pass over obstructions that may be encountered in the pipeline, and has an opening therein that receives a permanent magnet. The carrier segment has opposed surfaces that each receive a retainer plate, the retainer plates being held by bolts. The retainer plates are preferably in the form of soft iron or other para-magnetic material so that the retainer plates function as pole pieces for the magnet.

FIGS. 6 and 7 show enlarged detail of the exemplary segmented members, each being generally indicated by the numeral 30. Each of the segmented members in the arrangement of FIG. 6 and 7 is preferably formed of an elastomer, such as polyurethane although other types of materials may be employed. Each of the segmented members includes an inner end 32 and an outer end 34 and the sidewalls of the segmented members are each tapered to be in the general shape of a segment of a circle. Formed within each segmented member adjacent the outer end 34 is an opening 36 which receives a permanent magnet 38. To maintain a magnet 38 within an opening 36, opposed retainer plates 40A and 40B are employed, the retainer plates being affixed to the external surfaces of the segmented member and held in place by means of bolts 42A and 42B. In the illustrated arrangement, each bolt has an enlarged head that is received within a tapered recess in plate 40B, each bolt extending into threaded inserts (not shown) in segments 30. Other means may be provided for securing retainer plates 40A and 40B to segmented member 30 so as to retain magnet 38 in position.

In the illustrated embodiment, opening 36 is rectangular so as to receive a magnet that is rectangular in cross-sectional configuration. The opening 36 could be circular to receive a magnet having a circular cross-section.

Retainer plates 40A and 40B are preferably formed of soft steel or other para-magnetic material so that the retainer plates serve the dual function of securing a magnet 38 within an opening 36 of each of the segmented members 30 plus the retainer plates function as pole pieces, that is, pieces that concentrate the magnetic lines of flux created by a magnet 38 to provide more effective attraction of ferro-magnetic debris.

In the embodiment illustrated in FIG. 2, five of the segmented members are illustrated in aligned relationship secured to ring 28. In the usual method of construction, an equal number of segmented members is secured to each ring 28. The use of segmented members of the type illustrated in FIGS. 6 and 7 is a preferred method of practicing the invention, however, the invention is not limited to the use of such segmented members. For instance, as seen in FIGS. 1 and 2, all of the segmented members 30 could be in the form of a single carrier supporting one or more permanent magnets. Further, the specific configuration of each of the segmented members of FIGS. 6 and 7 can vary considerably while still within the scope of the invention.

The array of segmented members as shown in FIG. 2 provides a carrier having a generally circular peripheral surface indicated by dotted line 44. That is, while as shown in FIG. 6, the outer end 34 of each of the segmented members may be straight, nevertheless the assembly of segmented members provides a generally circular peripheral surface 44 that is concentric with and spaced from the pipeline internal wall 14.

Circular guide 24 having a circumferential groove therein is illustrative of one arrangement for rotationally supporting a permanent magnet or magnets about body 18. The circular guide can take other forms. For instance, the circular guide can be a planar member welded or otherwise secured to the exterior of body 18 with a pair of rings rotating around body 18 guided by the planar member with segmented members 30 secured between the rotatable rings.

A pipeline pig, if substantially balanced around its longitudinal axis will sometimes rotate as it moves through a pipeline. For this reason others in providing magnetic pigs have characteristically provided magnets equally spaced around the entire periphery of the pipeline, such as illustrated in U.S. Pat. Nos. 5,461,746 and 4,113,611. However, as previously stated, ferro-magnetic debris is concentrated substantially exclusively in the gravitationally downward bottom portion 16 of a pipeline. By this invention as illustrated in FIGS. 1 and 2, a segmented disc or discs will remain adjacent to the pipeline interior body 16 since the weight of the segmented discs including the weight of the magnets carried by them will cause rings 28 to rotate in raceways 26 of circular guides 24. Thus, as the pig 10 moves through a pipeline, the rotation of the pig will not effect the ability of the pig to attract ferro-magnetic debris from the interior bottom surface of the pipeline.

Figure 3:
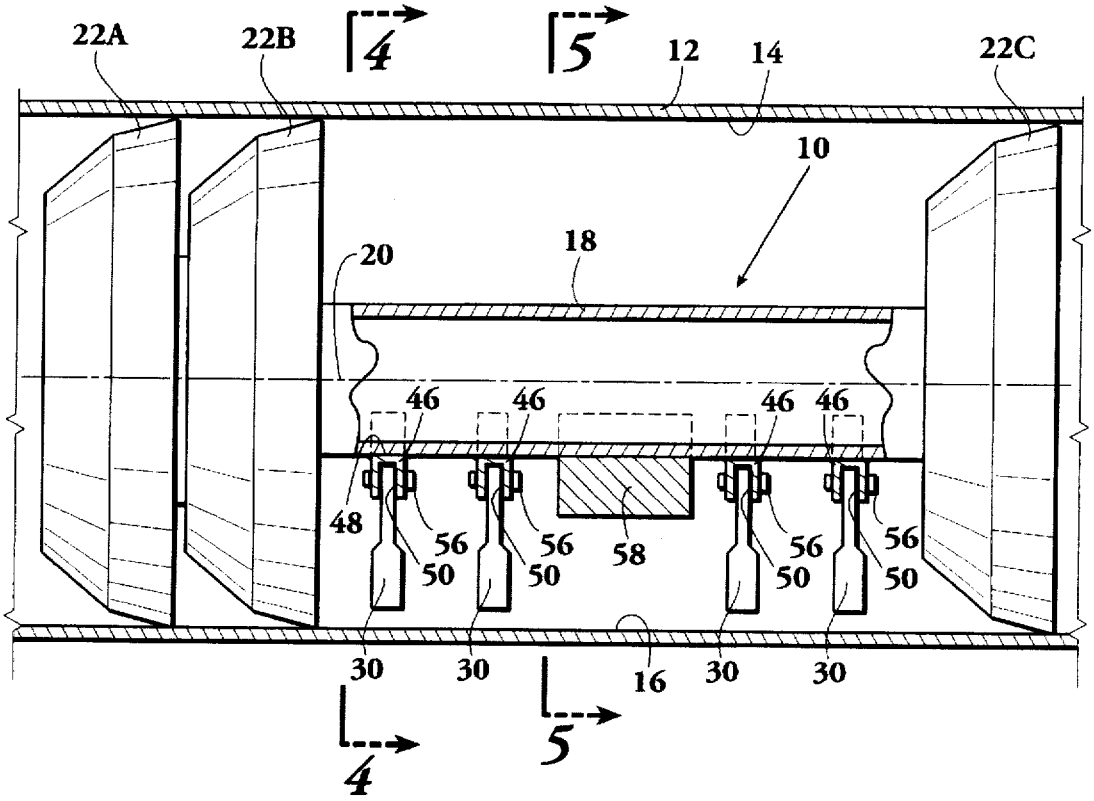
FIG. 3 is an elevational cross-sectional view as shown in FIG. 1 but showing another embodiment of the invention wherein the cleaning device is provided with a weight that is off center with respect to the longitudinal axis of the cleaning device to thereby prohibit the cleaning device from rotating as it passes through a pipeline and to thereby maintain the magnet or magnets secured to the carrier in close proximity to the pipeline interior bottom surface.
Figure 4:
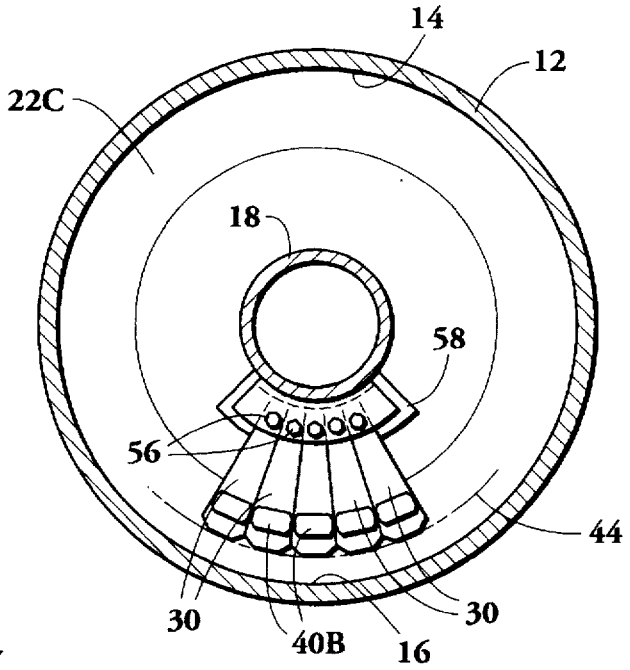
FIG. 4 is a first elevational cross-sectional view taken along the line 4—4 of FIG. 3, showing the segments having magnets therein as supported by the body.
Figure 5:
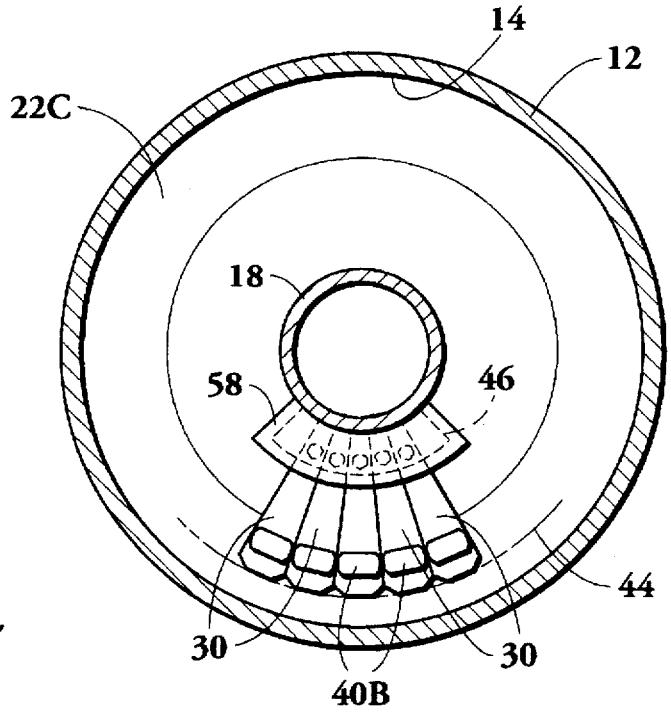
FIG. 5 is a cross-sectional view taken along the line 5—5 of FIG. 3 showing more particularly the configuration of the weight attached to the body, the weight serving to prevent the body from rotating as it passes through a pipeline and to thereby insure that the magnet carrying segments will remain in close proximity to the pipeline interior bottom surface.

FIGS. 3, 4 and 5 illustrate an alternate embodiment of the invention in which the pipeline pig 10 is of generally the same structure as previously described. However, in this embodiment rather than circular guides, brackets 46 are secured to the exterior surface of body 18. Each of the brackets has a semi-circular interior surface 48 that conforms to the exterior surface of body 18 and the brackets are secured to the body such as by welding or the brackets may be bolted or otherwise secured to the body. In the embodiment of FIG. 3, four brackets 46 are secured to body 18.

Each of the brackets has a semi-circular groove 50 therein that receives the upper end portion 32 of a plurality of segmented members, such as segmented members illustrated and described with reference to FIGS. 6 and 7. As shown in FIG. 6, each of the segmented members has a hole 52 therethrough adjacent inner end 32. In the embodiment of FIG. 1, bolts 54 extend through the holes to attach each segmented member 30 to a ring 28 whereas in the embodiment of FIGS. 3 through 5, bolts 56 secure the upper end portion of each segmented member 30 to a bracket 46.

In the illustrated arrangement of FIGS. 3 through 5 segmented members 30 are rotatably secured to body 18, that is, they rotate with the body. Thus, in this embodiment if the pig rotates as it moves through a pipeline segmented members 30 will rotate with body 18. In order to make sure that the segmented members remain oriented so as to position magnets adjacent pipeline interior bottom surface 16, it is necessary to provide means to prevent the pig from rotating. This is accomplished by employing a weight 58 that is secured to the pig body so that the pig will have a weight bias with respect to the longitudinal axis 20 that prevents the pig from rotating and that causes the segmented members 30 to always extend in the direction towards the pipeline interior bottom portion 16. While in the embodiment illustrated, a weight 58 is shown attached directly to body 18, the weight could be secured to internal portions of elastomeric cups 22. The particular arrangement, configuration of and placement of weight 58 is not critical to the invention only that a weight be secured to the pipeline pig 10 so that the body 18 does not rotate significantly about its longitudinal axis 20 as the pig moves through a pipeline to thereby insure that the segmented members 30 extend in the direction towards the pipeline interior bottom portion 16.

As was stated with respect to FIGS. 1 and 2, in the embodiment of FIGS. 3, 4 and 5, a plurality of individual segmented members 30 are illustrated, it being understood that this arrangement could be replaced by a single large segmented member secured to the body and having one or more permanent magnets therein. The use of a plurality of individual segmented members has the advantage that the number of such segments as required for different size pigs can be varied employing the same segmented members as illustrated in FIGS. 6 and 7 to thereby adapt the design to various sizes of pipelines while using the same segmented members 30.

Others have shown the concept of using weight to rotational bias a pipeline pig to prevent its rotation, such as U.S. Pat. Nos. 4,057,081 and 4,717,875 but such uses have been made for purposes other than magnetic cleaning pigs.

Brackets 46 are illustrated as having a circumferential groove 50 therein for supporting segmented members 30. The use of a bracket having a groove is by example only. The bracket can be in the form of planar member circumferentially received about and welded or otherwise attached to body 18. One or more segmented members 30 can be secured to such planar member by bolts. Any method of securing one or more magnet supporting segmented members to the exterior of body 18 can be employed in practicing the invention.

The illustrated embodiment of the invention show two basic concepts, that is, the concept of FIGS. 1 and 2 wherein rotatable rings are provided so that the debris gathering magnets are always positioned adjacent the lower interior bottom surface of a pipeline irrespective of the rotation of the pipeline pig, and the embodiment of FIGS. 3 through 5 where, by means of weight biasing the pipeline pig is prevented from rotation. Each of these embodiments achieves the basic goal of providing a carrier supported by the body having a circumferential surface at least a portion of which is substantially concentric to and spaced adjacent to the pipeline interior wall 14, and particularly to interior wall gravitationally downward bottom portion 16.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A cleaning device for passing through a pipeline to gather and remove ferro-magnetic debris, the pipeline having a cylindrical internal wall with a gravitationally downward internal bottom portion, which device comprises:

an elongated body of cross-sectional dimension less than that of the pipeline cylindrical internal wall;

at least two supports, spaced apart from each other and affixed to said elongated body whereby said elongated body is supported at least substantially co-axially of the pipeline cylindrical wall;

a carrier supported by said body and having a circumferential surface at least a portion of which provides a generally circular peripheral surface at least substantially concentric to and spaced adjacent to the pipeline internal wall;

at least one permanent magnet retained by said carrier adjacent to said carrier circular peripheral surface; and means to orientationally maintain said carrier circular peripheral surface in the direction of and adjacent the pipeline internal wall gravitationally downward bottom portion whereby at least a portion of any ferro-magnetic debris residing in the pipeline will be picked up by said at least one permanent magnet.

2. A cleaning device according to claim 1 wherein at least one of said supports is an elastomeric member having a peripheral surface at least substantially engaging and slidable relative to the pipeline cylindrical internal wall.

3. A cleaning device according to claim 2 wherein said elastomeric member is in a substantially cup-like configuration.

4. A cleaning device according to claim 1 wherein said carrier is in the form of a plurality of segmented members each supported by said body and each having a segment of a circular peripheral surface that is at least substantially concentric to and spaced from the pipeline internal wall and wherein said at least one permanent magnet includes an individual permanent magnet retained by each of said segmented members.

5. A cleaning device according to claim 4 wherein each of said plurality of segmented members is in the form of an elastomeric disc segment having an opening therethrough, and wherein a said individual magnet is positioned in said opening.

6. A cleaning device according to claim 5 wherein each of said plurality of segmented members has opposed surfaces with which said opening therein communicates and including first and second retainer plates secured to each said segmented member, one on each of said opposed surfaces, each retainer plate extending across said opening, said retainer plates serving to retain said individual permanent magnet in position in said opening.

7. A cleaning device according to claim 6 wherein each of said plates is formed of para-magnetic material and functions as a pole piece for said individual permanent magnet.

8. A cleaning device according to claim 1 including at least one guide secured to and surrounding said body in a plane perpendicular to an elongational axis of said body; and a ring rotatably received about said body and rotationally retained in place by said guide, said carrier being attached to said ring, said ring rotationally responding to gravitationally pull on said carrier providing said means to orientationally maintain said carrier peripheral surface in the direction of and adjacent the pipeline internal wall gravitationally downward bottom portion.

9. A cleaning device according to claim 1 wherein said carrier is at least substantially fixedly supported to said body, including weight secured to one of said body and said supports sufficient to prevent said body from rotating as said device passes through a pipeline, said carrier and said weight being positioned to orientationally maintain said carrier peripheral surface in the direction of and adjacent the pipeline internal wall gravitationally downward bottom portion.

10. A cleaning device for passing through a pipeline to gather and remove ferro-magnetic debris, the pipeline having a cylindrical internal wall with a gravitationally downward bottom portion, which device comprises:

an elongated body of cross-sectional dimension less than that of the pipeline cylindrical internal wall;

at least two supports, spaced apart from each other and affixed to said elongated body whereby said elongated body is supported at least substantially co-axially of the pipeline cylindrical wall;

a segmented member supported by said body and having a segment of a circular peripheral surface at least substantially concentric to and spaced from the pipeline internal wall;

at least one permanent magnet retained by said segmented member adjacent to said peripheral surface thereof;

at least one circular guide secured to and surrounding said body, the circular guide having a circumferential raceway formed therein that is in a plane perpendicular to an elongational axis of said body; and a ring rotatably received in said circumferential raceway, said segmented member being attached to said ring, said ring rotationally responding to the weight of said segmented member to orientationally maintain said segmented member peripheral surface in the direction of and adjacent the pipeline internal wall gravitationally downward bottom portion.

11. A cleaning device according to claim 10 wherein at least one of said supports is an elastomeric member having a peripheral surface at least substantially engaging and slidable relative to the pipeline cylindrical internal wall.

12. A cleaning device according to claim 11 wherein said elastomeric member is in a substantially cup or disc-like configuration.

13. A cleaning device according to claim 10 wherein said segmented member is in the form of a plurality of segmented members each supported by said ring and each having a segment of a circular peripheral surface that is at least substantially concentric to and spaced from the pipeline internal wall and wherein said at least one permanent magnet includes an individual permanent magnet retained by each of said segmented members.

14. A cleaning device according to claim 13 wherein each of said plurality of segmented members is in the form of an elastomeric disc segment having an opening therethrough, and wherein a said individual magnet is positioned in said opening.

15. A cleaning device according to claim 14 wherein each of said plurality of segmented members has opposed surfaces with which said opening therein communicates and including first and second retainer plates secured to each said segmented member, one on each of said opposed surfaces, each retainer plate extending across said opening, said retainer plates serving to retain said individual permanent magnet in position in said opening.

16. A cleaning device according to claim 15 wherein each of said plates is formed of para-magnetic material and functions as a pole piece for said individual permanent magnet in position in said opening.

17. A cleaning device for passing through a pipeline to gather and remove ferro-magnetic debris, the pipeline having a cylindrical internal wall with a gravitationally downward internal bottom portion, which device comprises:

an elongated body of cross-sectional dimension less than that of the cylindrical internal wall;

at least two supports, spaced apart from each other and affixed to said elongated body whereby said elongated body is supported at least substantially co-axially of the pipeline cylindrical wall;

a carrier supported by said body and having a circular peripheral surface at least substantially concentric to and spaced adjacent to the pipeline internal wall;

at least one permanent magnet retained by said carrier adjacent to said circular peripheral surface; and a weight secured to one of said body and said supports sufficient to prevent said body from rotating as said device passes through a pipeline, said carrier and weight being positioned to orientationally maintain said circular peripheral surface of said carrier in the direction of and adjacent the pipeline internal wall gravitationally downward bottom portion.

18. A cleaning device according to claim 17 wherein at least one of said supports is an elastomeric member having a peripheral surface at least substantially engaging and slidable relative to the pipeline cylindrical internal wall.

19. A cleaning device according to claim 18 wherein said elastomeric member is in a substantially cup or disc-like configuration.

20. A cleaning device according to claim 17 wherein said carrier is in the form of a plurality of segmented members each supported by said body and each having a segment of a circular peripheral surface that is at least substantially concentric to and spaced from the pipeline internal wall and wherein said at least one permanent magnet includes an individual permanent magnet retained by each of said segmented members.

21. A cleaning device according to claim 20 wherein each of said plurality of segmented members is in the form of an elastomeric disc segment having an opening therethrough, and wherein a said individual magnet is positioned in said opening.

22. A cleaning device according to claim 21 wherein each of said plurality of segmented members has opposed surfaces with which said opening therein communicates and including first and second retainer plates secured to each said segmented member, one on each of said opposed surfaces, each retainer plate extending across said opening, said retainer plates serving to retain said individual permanent magnet in position in said opening.

23. A cleaning device according to claim 22 wherein each of said plates is formed of para-magnetic material and functions as a pole piece for said individual permanent magnet in position in said opening.

* * * * *